US006494349B1

(12) United States Patent
Thompson et al.

(10) Patent No.: US 6,494,349 B1
(45) Date of Patent: Dec. 17, 2002

(54) HAND-HELD PRODUCT DISPENSERS HAVING PRESSURIZED DELIVERY

(75) Inventors: Harold Rand Thompson, Norwell, MA (US); Gordon Gerald Guay, Chelmsford, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/442,347

(22) Filed: Nov. 17, 1999

(51) Int. Cl.[7] ..... B65D 83/00

(52) U.S. Cl. ..... 222/402.15; 222/310; 222/505

(58) Field of Search ..... 222/402.15, 402.21, 222/402.25, 505, 402.13, 472, 287, 310; 401/190

(56) References Cited

U.S. PATENT DOCUMENTS

| | | | | |
|---|---|---|---|---|
| 2,643,914 A | | 6/1953 | Reswick | |
| 2,746,797 A | | 5/1956 | Remane | |
| 2,879,925 A | | 3/1959 | Remane | |
| 2,897,526 A | * | 8/1959 | Dootson | 401/190 |
| 2,995,308 A | | 8/1961 | Ashkenaz | 239/302 |
| 3,093,857 A | | 6/1963 | Hersh | |
| 3,109,565 A | | 11/1963 | Kutik | |
| 3,138,331 A | | 6/1964 | Kutik | |
| 3,189,232 A | | 6/1965 | Joffe | |
| 3,252,626 A | | 5/1966 | Belka | |
| 3,429,484 A | * | 2/1969 | Baldwin | 222/402.13 |
| D218,145 S | | 7/1970 | Doblin | |
| 3,648,905 A | | 3/1972 | Kauder | 222/402.21 |
| D234,074 S | | 1/1975 | Nilsson | |
| 3,987,942 A | * | 10/1976 | Morane et al. | 222/402.15 |
| 4,077,549 A | | 3/1978 | Beard | 222/321 |
| 4,089,609 A | * | 5/1978 | Gring et al. | 401/190 |
| 4,111,338 A | | 9/1978 | Cheng et al. | 222/180 |
| 4,157,774 A | | 6/1979 | Nicallef | 222/321 |
| 4,186,855 A | * | 2/1980 | Edman et al. | 222/472 |
| 4,264,037 A | | 4/1981 | Nozawa | 239/333 |
| 4,636,102 A | | 1/1987 | Drake | 401/190 |
| 4,733,984 A | | 3/1988 | Katsuda et al. | 401/190 |
| 4,826,054 A | | 5/1989 | Frutin | 222/402.11 |
| 5,040,705 A | | 8/1991 | Snell | 222/402.15 |
| 5,119,806 A | | 6/1992 | Palson et al. | 128/200.14 |
| 5,147,075 A | | 9/1992 | Regan | 222/402.15 |
| 5,186,364 A | * | 2/1993 | Laszlo | 401/190 |
| 5,348,189 A | | 9/1994 | Cater | 222/341 |
| 5,489,048 A | | 2/1996 | Stern et al. | 222/402.1 |
| 5,524,798 A | | 6/1996 | Stern et al. | 222/402.1 |
| 5,571,246 A | | 11/1996 | Alldredge | 128/200.23 |
| 5,645,198 A | | 7/1997 | Stern et al. | 222/402.1 |
| 5,655,691 A | | 8/1997 | Stern et al. | 222/402.1 |
| 5,715,975 A | | 2/1998 | Stern et al. | 222/402.1 |
| 5,921,446 A | | 7/1999 | Stern | 222/402.1 |
| 5,937,874 A | | 8/1999 | Guay et al. | 132/321 |
| 6,016,938 A | | 1/2000 | Eichorst | 222/402.15 |
| 6,029,862 A | | 2/2000 | Jones | 222/402.11 |

FOREIGN PATENT DOCUMENTS

JP JP 07 285586 10/1995

OTHER PUBLICATIONS

International Search Report for PCT/US00/42019.

* cited by examiner

*Primary Examiner*—Joseph A. Kaufman
(74) *Attorney, Agent, or Firm*—Fish & Richardson P.C.

(57) ABSTRACT

A hand-held pressurized product dispenser that includes a container with a hand-engageable body portion, a valve mechanism at the top of the container that is movable with respect to the container to cause pressurized discharge of the product, and a valve actuation lever that is connected to the valve mechanism and extends along the container body such that a larger displacement of the end of the lever causes a controlled, relatively smaller displacement of the valve mechanism, permitting adjustable "throttled" delivery of the product. Also disclosed are: a product delivery member that is attached to the top of container and has a product holding structure that is positioned with respect to the valve mechanism to receive product and to hold the product in position for application; cam members are oriented to cause the valve actuating lever to move downward as it is moved toward the container body: and a movable stop member that is carried on the container and faces the hand-engageable portion so as to limit travel of the hand-engageable portion toward the container.

34 Claims, 9 Drawing Sheets

HAND-HELD PRODUCT DISPENSERS HAVING PRESSURIZED DELIVERY

BACKGROUND OF THE INVENTION

The invention relates to hand-held product dispensers having pressurized delivery.

Various products have been conveniently dispensed in a pressurized form from a hand-held container such as a spray can. Typically a push button on top of the can is depressed to actuate a valve that provides an open path from the material in the container to a spray nozzle on the push button that directs the pressurized material in a direction that is perpendicular to the push button direction. This push button type of mechanism is often used for antiperspirant, deodorant and shaving cream dispensers.

Alternatively, some valves are actuated by providing a tilt (sideways push) action to an elongated tubular nozzle that directs the product along the axis of the can. Such valves are often employed in whipped cream dispensers.

SUMMARY OF THE INVENTION

In one aspect, the invention features, in general, a hand-held pressurized product dispenser that includes a container with a hand-engageable body portion, a valve mechanism at the top of the container that is movable with respect to the container to cause pressurized discharge of the product, and a valve actuation lever that is connected to the valve mechanism and extends along the container body. With this arrangement, a larger displacement of the end of the lever causes a controlled, relatively smaller displacement of the valve mechanism, permitting adjustable, "throttled" delivery of the product.

In another aspect, the invention features, in general, a hand-held pressurized product dispenser that includes a container with a hand-engageable body portion, a valve mechanism at the top of the container, and a valve actuation lever that extends along the container body. The product dispenser also includes a product delivery member that is attached to the top of container and has a product holding structure that is positioned with respect to the valve mechanism to receive product and to hold the product in position for application.

Preferred embodiments of the invention may include one or more of the following features. The product holding structure can take a variety of forms to assist in applying product. For example, it can have a generally flat upper surface or an arcuate surface. The product holding structure can be a porous structure having pores that receive the product. The product holding structure can be an elastomeric applicator. The product holding structure can be a sintered structure. The product holding structure can have a textured surface. The product holding structure can have a grid surface.

In another aspect, the invention features, in general, a hand-held pressurized product dispenser that includes a container with a hand-engageable body portion, a valve mechanism at the top of the container, and a valve actuation member that has a hand-engageable portion that extends along the container body. The valve mechanism is movable away from the container to discharge the product, and the valve actuating member is connected to move the valve mechanism away from the container as the hand-engageable portion is moved toward the body portion of the container.

In another aspect, the invention features, in general, a hand-held pressurized product dispenser that includes a container with a hand-engageable body portion, a valve mechanism at the top of the container, and a valve actuation member that is made of plastic and has a hand-engageable portion that extends along the container body and is pivotally connected with respect to the container via a living hinge.

In another aspect, the invention features, in general, a hand-held pressurized product dispenser that includes a container with a hand-engageable body portion, a valve mechanism at the top of the container, and a valve actuation member that has a hand-engageable portion that extends along the container body. The valve actuation member has a pivot end that is pivotally connected with respect to the container and also has a valve engaging portion that engages the valve mechanism and is located between the pivot end and the hand-engageable portion. Alternatively the pivot can be located between the valve engaging portion and the hand-engageable portion.

In another aspect, the invention features, in general, a hand-held pressurized product dispenser that includes a container with a hand-engageable body portion, a valve mechanism at the top of the container, and a valve actuation member that has a hand-engageable portion that extends along the container body. The hand-engageable portion of the valve actuation member has a first cam member that faces the container, and the container carries a second cam member that faces the first cam member. The first and second cam members are oriented such that, as the hand-engageable portion is moved toward the container, interaction of the first and second cam surfaces causes the valve actuating member to move downward to actuate the valve mechanism.

In another aspect, the invention features, in general, a hand-held pressurized product dispenser that includes a container with a hand-engageable body portion, a valve mechanism at the top of the container, and a valve actuation member that has a hand-engageable portion that extends along the container body. The container carries a movable stop member that faces the hand-engageable portion so as to limit travel of the hand-engageable portion toward the container. The stop member has different portions that are selectively movable into position facing the hand-engageable portion so as to adjust movement of the valve actuating member.

The dispensers can be used to dispense various products such as a shaving aid, an antiperspirant, a deodorant, a body spray, after shave lotion, hair spray, a liquid, a semi-solid, a gel, a cream or a powder. The container can be an aerosol container, a container having a product bag inside a pressurized chamber, or another type of container providing pressurized delivery of product.

Embodiments of the invention may include one or more of the following advantages. The throttling permtitted by the actuation lever allows the user to employ different types of sprays ranging from a fine mist to a hard spray. The side location of the actuation lever promotes accuracy in directing the product. The consumer has more control over product application and has the ability to personalize the application experience. The side location of the actuation lever also improves ergonomics. With the product holding structure on the container top, the user need not apply certain products to his or her hands prior to applying the products to the skin or hair.

Other advantages and features of the invention will be apparent from the following description of particular embodiments thereof and from the claims.

DESCRIPTION OF THE PREFERRED EMBODIMENTS

Figure 1:
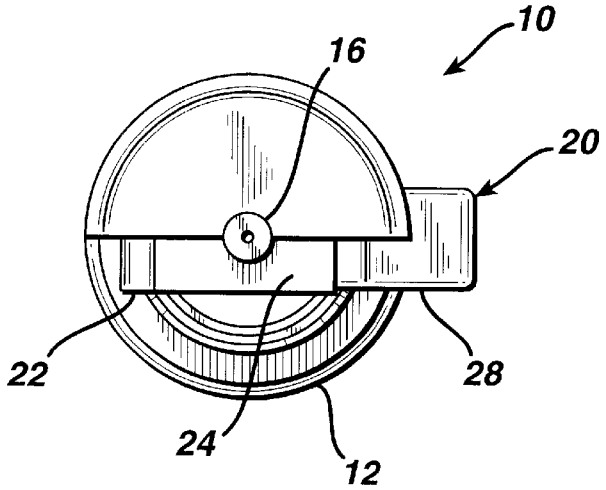
FIG. 1 is a plan view, with a cap component in section, of a product dispenser.
Figure 2:
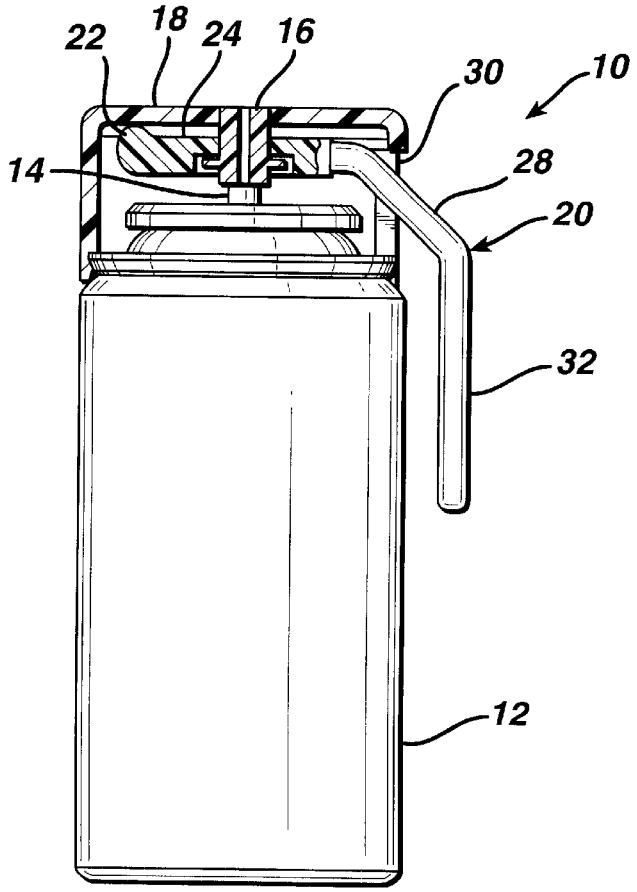
FIG. 2 is an elevation, with a cap component in section, of the FIG. 1 product dispenser.
Figure 3:
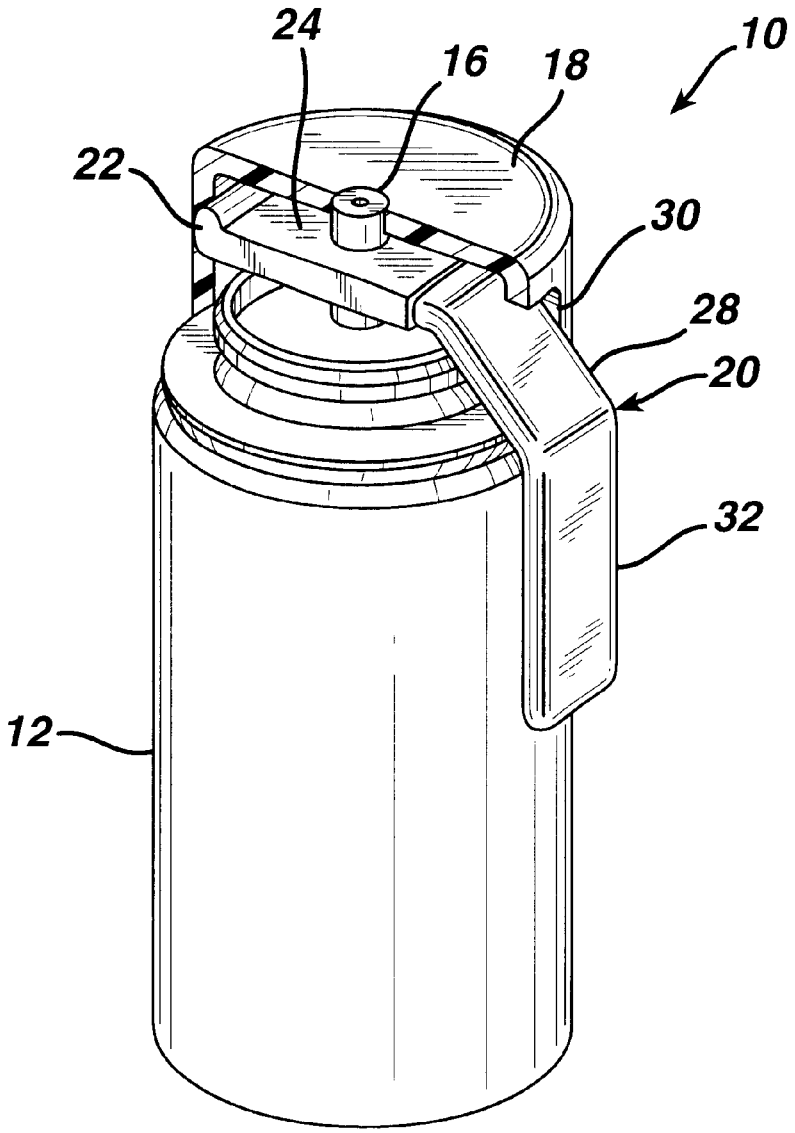
FIG. 3 is a perspective view, with a cap component in section, of the FIG. 1 product dispenser.

Referring to FIGS. 1–3, spray dispenser 10 includes aerosol container 12, having valve mechanism 14 of the type that is actuated by depression of nozzle 16, which directs the spray axially, unlike the typical finger-actuated push-button nozzle, which directs the spray radially. The majority of valve mechanism 14 is located inside container 12 at the top; a suitable valve mechanism, e.g., is the type used in commercial Right Guard antiperspirant dispensers. Dispenser 12 also includes a plastic cap 18, attached to the top of container 12, and valve actuation lever 20, which pivots at pivot end 22 underneath cap 18. Lever 20 includes upper portion 24, which extends along the interior upper surface of cap 18 and is connected to a lower portion of nozzle 16. Lever 20 also includes angled portion 28, which extends through opening 30 in cap 18, and hand-engaging portion 32, which extends along the body of container 12.

When using dispenser 10, the user holds the container in his or her hand, and squeezes hand-engaging portion 32 toward container 12, which results in a smaller downward depression of nozzle 16, owing to the longer moment arm at portion 32 than at nozzle 16. This permits the user to throttle and adjust the flow rate of the delivery of product from nozzle 16. The different types of sprays that can be employed range from a fine mist to a hard stream. The side location of actuation lever 20 improves ergonomics (reducing the extent of wrist deflection needed for actuation and use), and promotes accuracy in directing the product in addition to controlling the amount of product being dispensed. The consumer thus has more control over product application and has the ability to personalize the application experience. Dispenser 10 could also be used to dispense creams or gels under pressure, using either propellant or internal bladder technology (e.g., available from Sepro).

Figure 4:
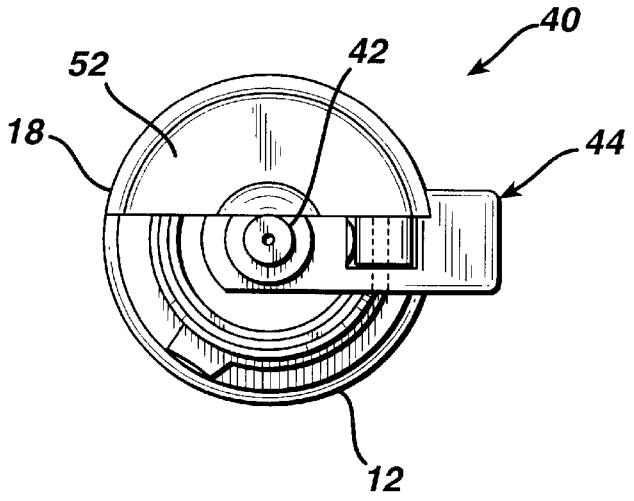
FIG. 4 is a plan view, with a cap component in section, of an alternative embodiment of a product dispenser.
Figure 5:
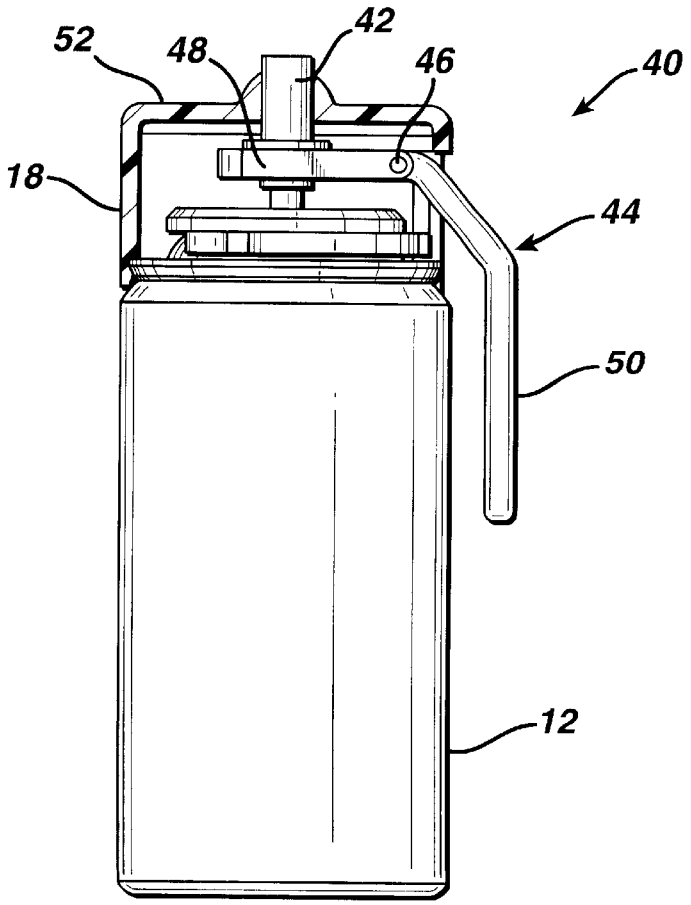
FIG. 5 is an elevation, with a cap component in section, of the FIG. 4 product dispenser.
Figure 6:
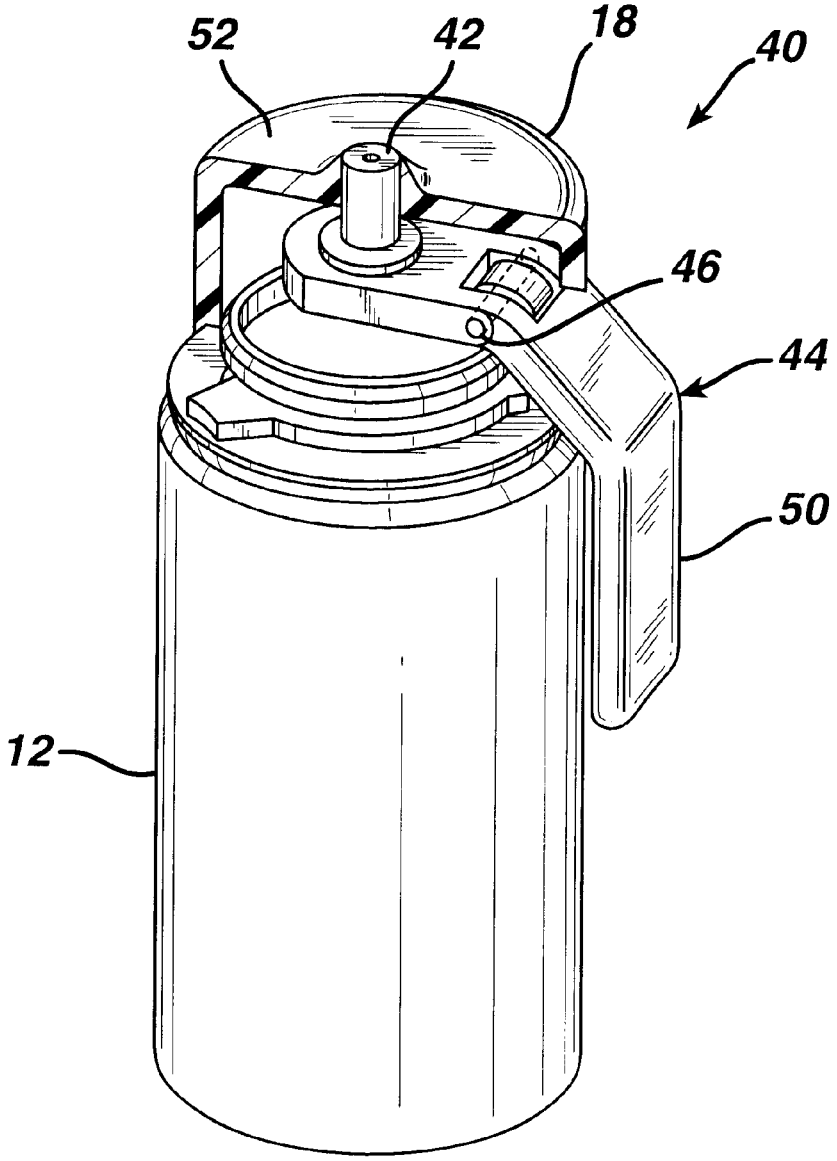
FIG. 6 is a perspective view, with a cap component in section, of the FIG. 4 product dispenser.

Referring to FIGS. 4–6, dispenser 40 is similar to dispenser 10 in that it includes container 12, cap 18, axially directed nozzle 42 and side actuation lever 44. Dispenser 40 differs from dispenser 10 in that nozzle 42 is actuated by extending it from container 12 (instead of depressing), and the pivot 46 for lever 44 is located between the end 48 connected to nozzle 42 and the hand-engaging portion 50, which extends along the body of container 12. With this arrangement, the product is dispensed with nozzle 16 extended above the upper surface 52 of cap 18. The dispensed product can be collected on surface 52, and nozzle 16 can then be retracted during application of the product, e.g., to a user's skin.

The cap 18 serves as a product delivery member, and its upper surface is a product holding structure.

Figure 7:
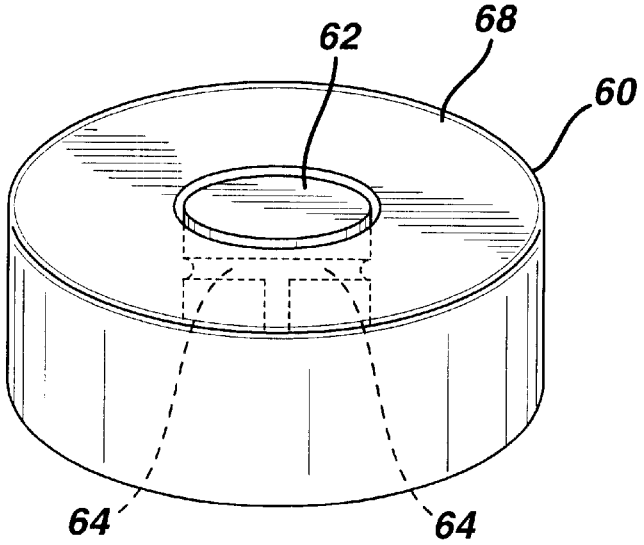
FIG. 7 is a perspective view of modified cap and nozzle components of the FIG. 4 product dispenser with the nozzle in a retracted position.
Figure 8:
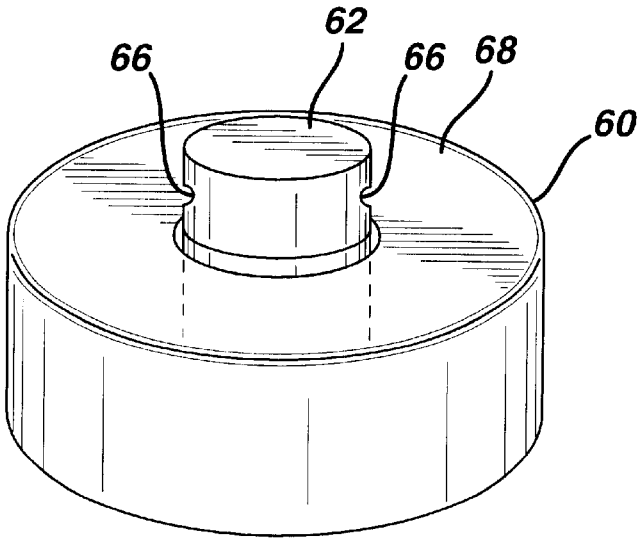
FIG. 8 is a perspective view of the FIG. 7 cap and nozzle components with the nozzle in an extended position.

Referring to FIGS. 7–8, modified cap 60 and nozzle 62 are shown. Nozzle 62 is in a retracted position in FIG. 7 and is in an extended, dispensing position in FIG. 8. Nozzle 62 has internal passageways 64 that direct the product to side openings 66, where the product is dispensed laterally, to the upper surface 68 of cap 60 in the extended position shown in FIG. 8. Cap 60 and nozzle 62 are desirably used on container 40 of FIGS. 4–6. The product is collected on the upper cap surface 68 prior to application to a user's skin. Thus a shaver can dispense and apply shaving cream without the need to put foam on his or her hands and without the need to rinse off the hands after applying the cream and prior to shaving. In addition, surface 68 can be provided with functional surfaces to provide efficacy, comfort or a combination of benefits. Surface 68 can be provided with a textured applicator. Surface 68 could be provided with flocked foam surface (e.g., available from TekPak in N.J. and Claremont Flock Inc. of Claremont, N.H.). Alternatively, porous sintered domes, of the type employed in Narta deodorant cans, can also be used. Surface 68 can be flat, as shown, or arcuate. It could also be provided with a grid structure or elastomeric applicator.

Thus cap 60 serves as a product delivery member, and its upper surface 68 is a product holding structure.

Figure 9:
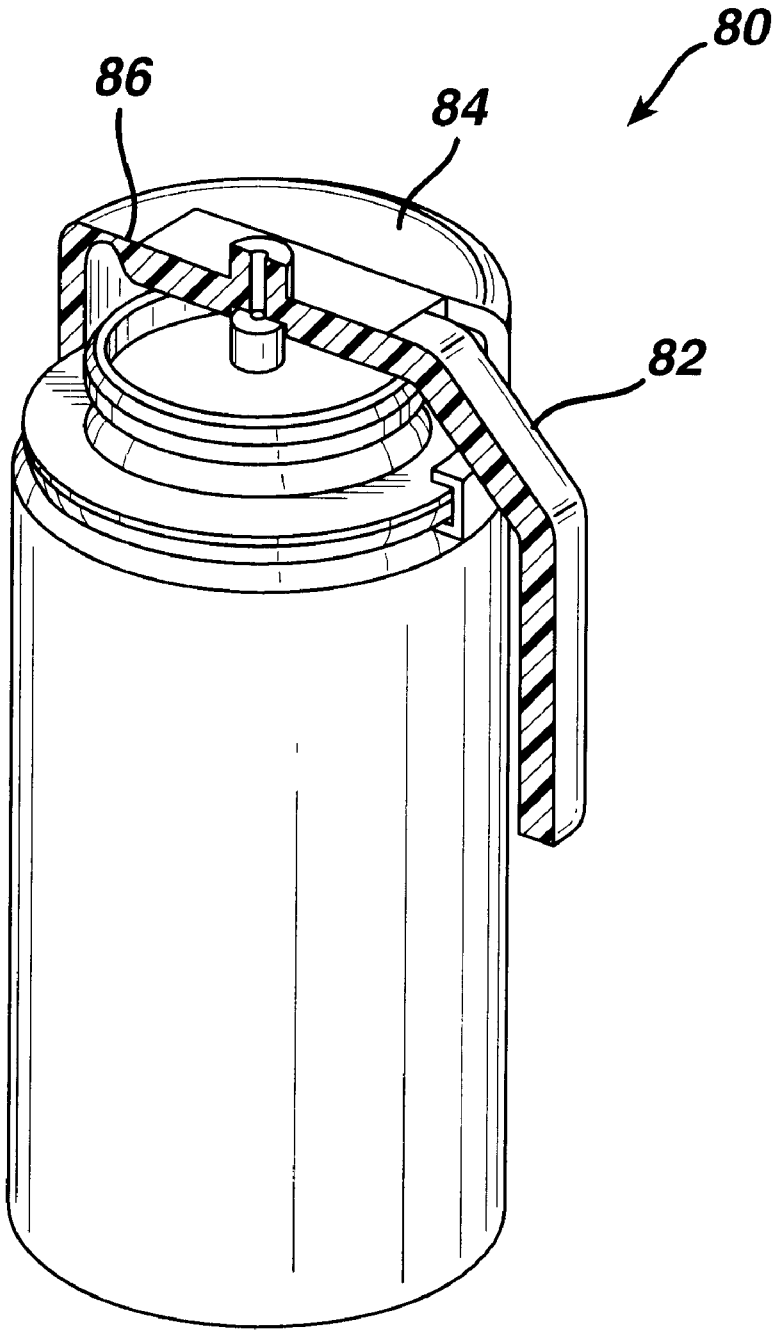
FIG. 9 is a perspective view, with a cap component in section, of a further alternative embodiment of a product dispenser.

Referring to FIG. 9, dispenser 80 is similar to dispenser 10, except that plastic lever 82 is integral with plastic cap 84 The upper end of lever 82 is pivotally connected to cap 84 at living hinge 86.

Figure 10:
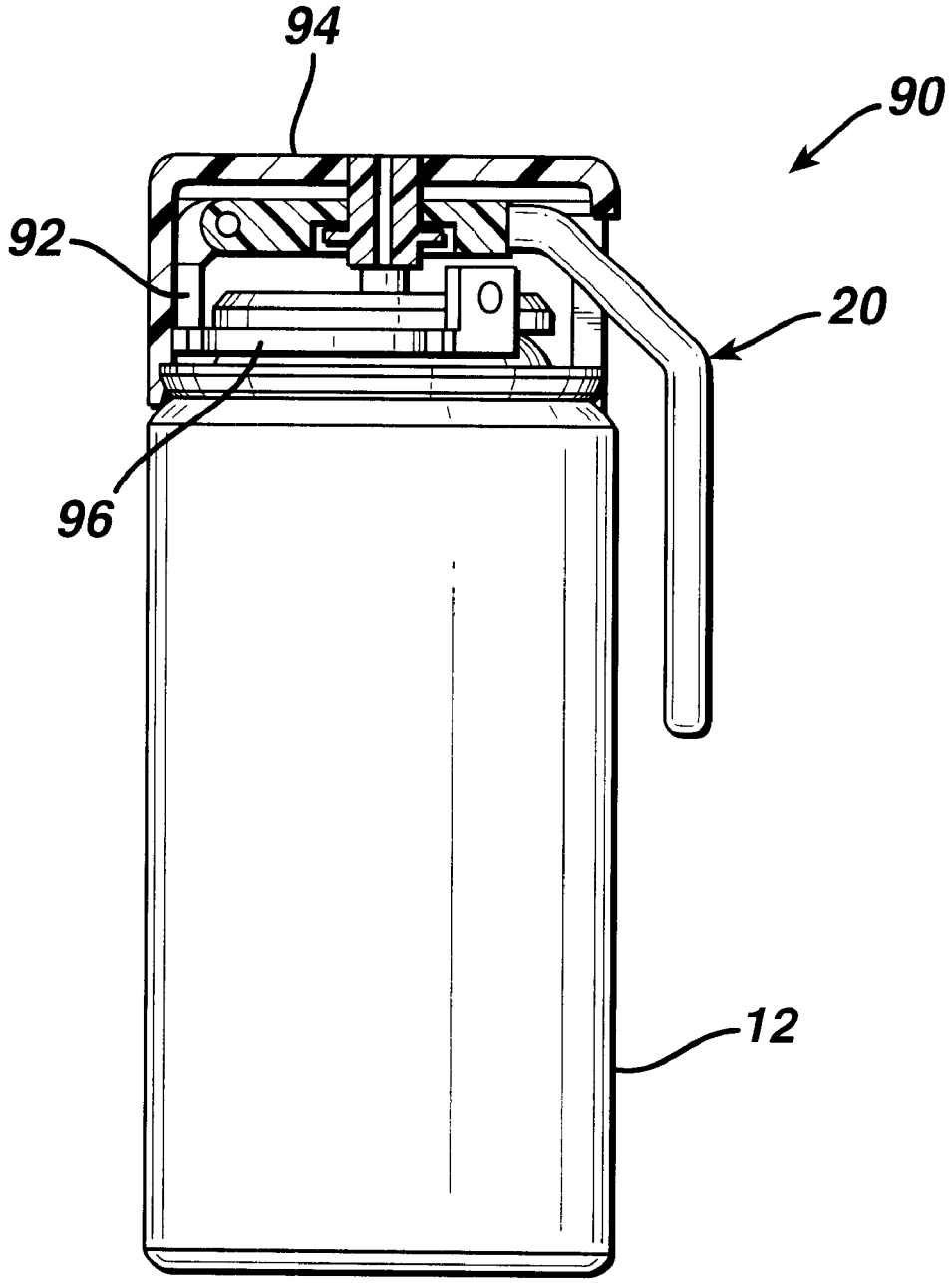
FIG. 10 is an elevation, with a cap component in section, of a further alternative embodiment of a product dispenser.

Referring to FIG. 10, dispenser 90 is similar to dispenser 10, except that it has the upper end of lever 20 pivotally connected to vertical support 92 instead of cap 94. Support 92 is attached to an upstanding circular structure on container 12 by ring 96. With dispenser 90, product can be dispensed with cap 94 on or with cap 94 off.

Figure 11:
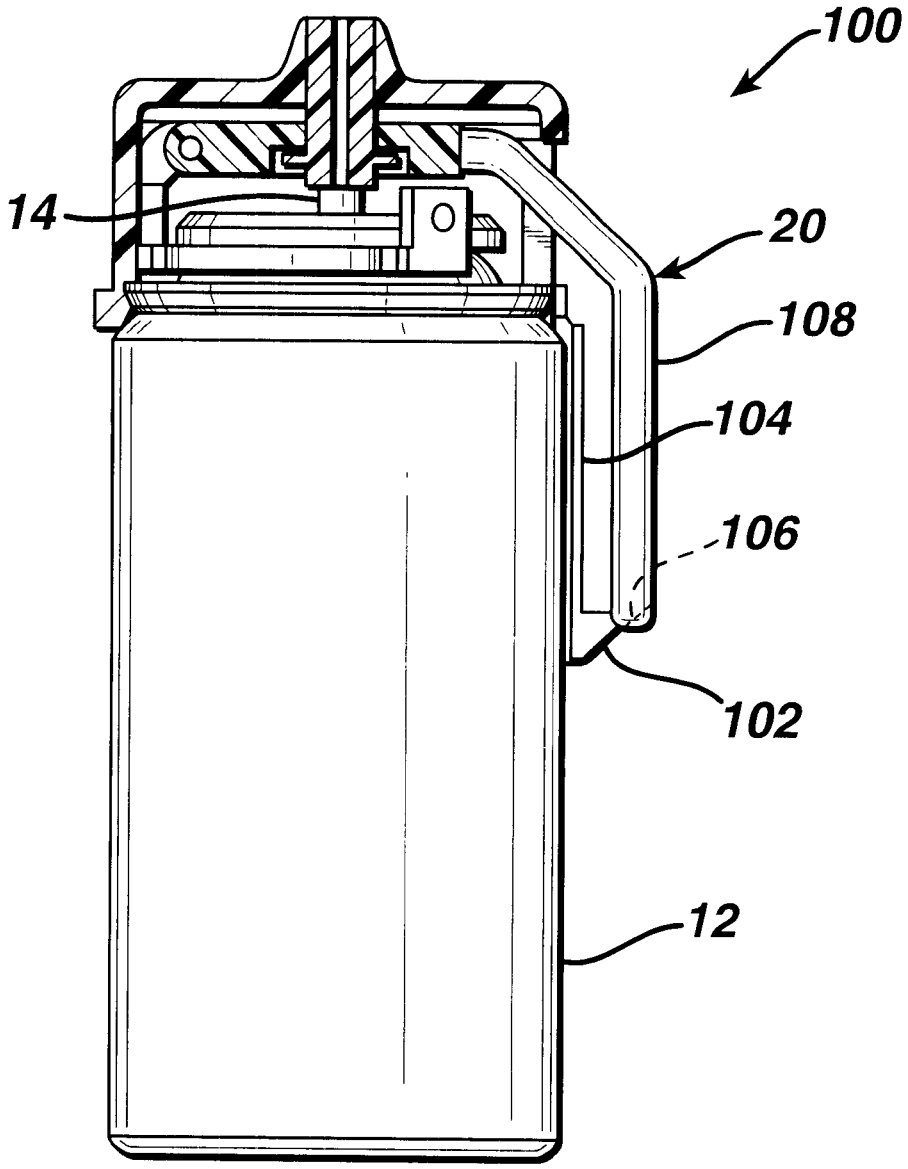
FIG. 11 is an elevation, with a cap component in section, of a further alternative embodiment of a product dispenser.

Referring to FIG. 11, dispenser 100 is similar to dispenser 90, except that it employs cam surface 102, on member 104 on container 12, and mating cam surface 106 on the inner side of hand-engaging lever portion 108 facing container 12. As hand-engaging portion 108 is squeezed toward container 12, surface 106 tends to slide downward (as well as inward) along surface 102, exerting a downward force in the lever 20 that assists in depressing valve 14 without requiring large angular movement of lever 20.

Figure 12:
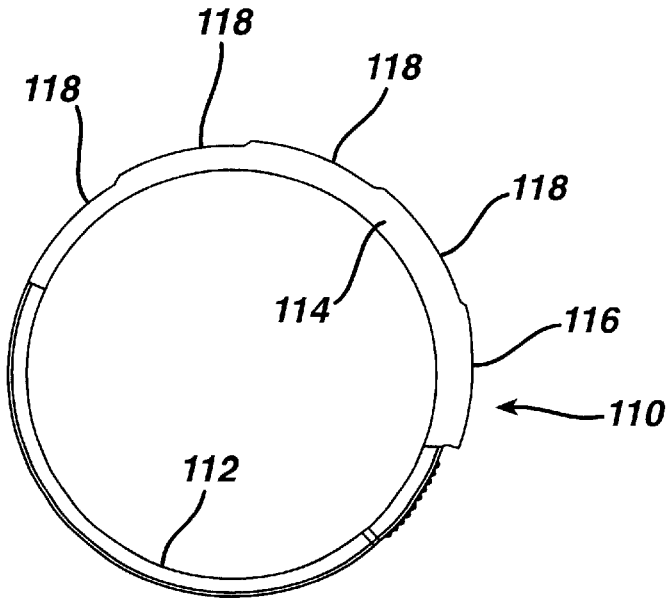
FIG. 12 is a plan view of an adjustable-stop ring component useful with the FIG. 11 dispenser.
Figure 13:
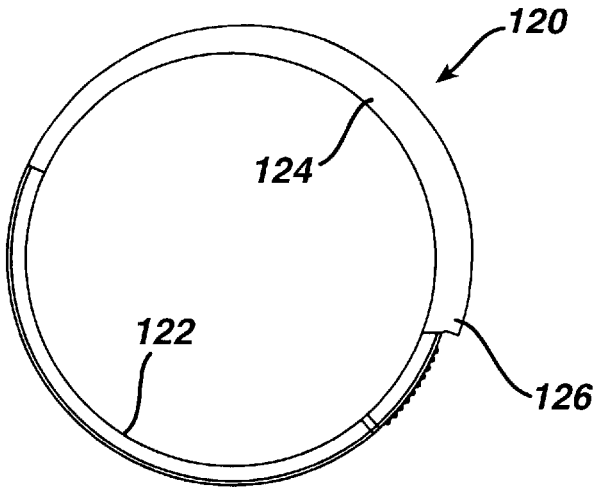
FIG. 13 is a plan view of an alternative embodiment of an adjustable-stop ring component useful with the FIG. 11 dispenser.

Referring to FIGS. 12 and 13, metering rings 110 and 120 are shown. Both rings 110, 120 are mounted on a respective container 12 aligned with, and inside of, a respective hand-engageable portion 108 of dispenser 100 shown in FIG. 11. Each ring 110, 120 has in internal portion 112, 122, respectively, which is fixedly secured on can 12, and an outer adjustable stop portion 114, 124, respectively, that can slide around fixed internal portion 112, 122, such that different areas can be aligned with the lever. On ring 110, stop portion 116 has the largest radius and acts as a lock, preventing any movement of lever 108. Stop portions 118 have different radii and permit different amounts of flow. On ring 120, the end 126 of stop portion 124 acts as a lock, while the remainder of stop portion 124 has a gradually decreasing radius, permitting selection of any stop position desired for movement of the hand-engageable portion 108.

With the large moment arms provided by the side levers, stronger springs can be employed in the valves. Stronger springs can enhance the throttle mechanism and have the added benefit of reducing propellant leakage owing to salt build-up around the valve's rubber gasket.

Other embodiments of the invention are within the scope of the appended claims.

Besides valves that are actuated by downward depression, valves with tilt actuation (e.g., as available from Summit Technologies, Manchester, NH under designation AX-11209 0.019 RT) can be used. In this case, the caps have oval or other shape openings that permit tilting of the nozzle.

What is claimed is:

1. A hand-held pressurized product dispenser comprising a container containing product under pressure, said container having a top, a hand-engageable body portion and a bottom, a valve mechanism at the top of said container that communicates with said container and is movable with respect to said container to cause pressurized axial discharge of said product out of said container via a nozzle outlet that is axially aligned with said container, and a valve actuation lever that is pivotally connected to said valve mechanism via a pivotal connection and extends along said body to a lever end such that relatively larger displacement of said lever end causes a controlled, relatively smaller displacement of said valve mechanism, permitting adjustable throttled delivery of said product.

2. The hand-held pressurized product dispenser of claim 1, said valve mechanism being movable away from said container to discharge said product, said valve actuation lever being connected to move said valve mechanism away from said container as said lever is moved toward said body.

3. The hand-held pressurized product dispenser of claim 1, said valve actuation lever being made of plastic and being pivotally connected with respect to said container via a living hinge.

4. The dispenser of claim 3 further comprising a cap on said container, and wherein said valve actuating member is integral with said cap.

5. The hand-held pressurized product dispenser of claim 1, said valve actuation lever having a pivot end that is pivotally connected with respect to said container and also having a valve engaging portion that engages said valve mechanism and is located between said pivot end and hand-engageable portion of said lever.

6. The hand-held pressurized product dispenser of claim 1, said valve actuation lever having a valve engaging portion that engages said valve mechanism and a pivot that pivotally connects said valve actuating member with respect to said container and is located between said valve engaging portion and hand-engageable portion of said lever.

7. The hand-held pressurized product dispenser of claim 1, said valve actuation lever having a first cam member that is connected to said hand-engageable portion and faces said container, said container carrying a second cam member that faces said first cam member, said first and second cam members being oriented such that, as a hand-engageable portion of said lever is moved toward said container, interaction of said first and second can surfaces causes said valve actuating member to move downward to actuate said valve mechanism.

8. The dispenser of claim 7 wherein said container carries a movable stop member facing said hand-engageable portion so as to limit travel of said hand-engageable portion toward said container, said stop member having different portions that are selectively movable into position facing said hand-engageable portion so as to adjust movement of said valve actuating member said container carrying a movable stop member facing said hand-engageable portion so as to limit travel of said hand-engageable portion toward said container, said stop member having different portions that are selectively movable into position facing said hand-engageable portion so as to adjust movement of said valve actuating member.

9. The hand-held pressurized product dispenser of claim 1, said container carrying a movable stop member facing a hand-engageable portion of said lever so as to limit travel of said hand-engageable portion toward said container, said stop member having different portions that are selectively movable into position facing said hand-engageable portion so as to adjust movement of said valve actuating member.

10. The dispenser of claim 9 wherein said stop member has stepped portions, each with a different radius.

11. The dispenser of claim 1 further comprising a product delivery member that is attached to said top of said container and has a product holding structure that is positioned with respect to said valve mechanism to receive said product.

12. The dispenser of claim 1 wherein said valve actuation lever is made of plastic and is pivotally connected with respect to said container via a living hinge.

13. The dispenser of claim 12 wherein further comprising a cap on said container, and wherein said valve actuation lever is integral with said cap.

14. A hand-held pressurized product dispenser comprising a container containing product under pressure, said container having a top, a hand-engageable body portion and a bottom, a valve mechanism at the top of said container that communicates with said container and is movable with respect to said container to cause pressurized discharge of said product out of said container, a product delivery member attached to said top of said container and having a product holding structure that is positioned with respect to said valve mechanism to receive said product, and a valve actuating member that is connected to actuate said valve and has a hand-engageable portion that extends along said body, the product holding structure is selected from a porous structure having pores that receive said product, an elastomeric applicator, a sintered structure, a structure having a textured surface, and a structure having a grid surface.

15. The dispenser of claim 14 wherein said product holding structure has a generally flat upper surface.

16. The dispenser of claim 14 wherein said product holding structure has a generally arcuate upper surface.

17. The dispenser of claim 14 wherein said product holding structure is said porous structure having pores that receive said product.

18. The dispenser of claim 14 wherein said product holding structure is said elastomeric applicator.

19. The dispenser of claim 14 wherein said product holding structure is said sintered structure.

20. The dispenser of claim 14 wherein said product holding structure is said structure having a textured surface.

21. The dispenser of claim 14 wherein said product holding structure is said structure having a grid surface.

22. The dispenser of claim 1 or 14 wherein said product is a shaving aid.

23. The dispenser of claim 1 or 14 wherein said product is an antiperspirant.

24. The dispenser of claim 1 or 14 wherein said product is a deodorant.

25. The dispenser of claim 1, 14 or 2 wherein said product is a body spray.

26. The dispenser of claim 1, 14 or 2 wherein said product is a gel.

27. The dispenser of claim 1, 14 or 2 wherein said product is a cream.

28. The dispenser of claim 1, 14 or 2 wherein said product is a semisolid.

29. The dispenser of claim 1, 14 or 2 wherein said product is a liquid.

30. The dispenser of claim 1, 14 or 2 wherein said product is an after shave.

31. The dispenser of claim 1, 14 or 2 wherein said product is a hair spray.

32. The dispenser of claim 1, 14 or 2 wherein said product is a powder.

33. The dispenser of claim 1, 14 or 2 wherein said container is an aerosol container.

34. The dispenser of claim 1, 14 or 2 wherein said container has a product bag inside a pressurized chamber.

* * * * *

UNITED STATES PATENT AND TRADEMARK OFFICE

CERTIFICATE OF CORRECTION

PATENT NO. : 6,494,349 B1
DATED : December 17, 2002
INVENTOR(S) : Thompson et al.

It is certified that error appears in the above-identified patent and that said Letters Patent is hereby corrected as shown below:

Column 2,
Line 48, insert -- - -- between "after" and "shave"
Line 54, replace "permtitted" with -- permitted --

Column 4,
Line 44, after "84" insert -- . --

Signed and Sealed this

Thirty-first Day of August, 2004

JON W. DUDAS
*Director of the United States Patent and Trademark Office*

US006494349C1

(12) EX PARTE REEXAMINATION CERTIFICATE (6265th)

United States Patent

Thompson et al.

(10) Number: US 6,494,349 C1

(45) Certificate Issued: Jun. 17, 2008

(54) HAND-HELD PRODUCT DISPENSERS HAVING PRESSURIZED DELIVERY

(75) Inventors: Harold Rand Thompson, Norwell, MA (US); Gordon Gerald Guay, Chelmsford, MA (US)

(73) Assignee: The Gillette Company, Boston, MA (US)

Reexamination Request:
No. 90/007,541, May 12, 2005

Reexamination Certificate for:

| | |
|---|---|
| Patent No.: | **6,494,349** |
| Issued: | **Dec. 17, 2002** |
| Appl. No.: | **09/442,347** |
| Filed: | **Nov. 17, 1999** |

Certificate of Correction issued Aug. 31, 2004.

(51) Int. Cl.
*B65D 83/00* (2006.01)

(52) U.S. Cl. ..... 222/402.15; 222/310; 222/505

(58) Field of Classification Search ..... None
See application file for complete search history.

(56) References Cited

U.S. PATENT DOCUMENTS

| | | | | | |
|---|---|---|---|---|---|
| 2,879,925 | A | * | 3/1959 | Remane | 222/213 |
| 3,426,948 | A | | 2/1969 | Stirling | |
| 3,592,359 | A | * | 7/1971 | Marraffino | 222/94 |
| 3,601,290 | A | | 8/1971 | Nigro | |
| 3,690,519 | A | | 9/1972 | Wassilieff | |
| 3,935,973 | A | * | 2/1976 | Weyn | 222/182 |
| 4,533,273 | A | * | 8/1985 | Obata et al. | 401/190 |
| 4,826,054 | A | * | 5/1989 | Frutin | 222/402.11 |
| 5,040,705 | A | | 8/1991 | Snell | |
| 5,130,015 | A | * | 7/1992 | Simizu et al. | 210/136 |
| 5,271,533 | A | * | 12/1993 | Joulia | 222/402.13 |
| 5,370,313 | A | * | 12/1994 | Beard | 239/337 |
| 5,379,924 | A | * | 1/1995 | Taylor | 222/402.11 |
| 5,813,785 | A | * | 9/1998 | Baudin et al. | 401/190 |
| 5,876,139 | A | * | 3/1999 | De Laforcade | 401/190 |
| 6,003,740 | A | | 12/1999 | Castaneda, Jr. | |
| 6,168,335 | B1 | * | 1/2001 | Mears et al. | 401/190 |
| 6,321,951 | B1 | | 11/2001 | Frutin | |

FOREIGN PATENT DOCUMENTS

| | | | |
|---|---|---|---|
| EP | 0 818 401 A1 | | 1/1998 |
| FR | 2081931 | * | 10/1971 |
| FR | 2152479 | | 4/1973 |
| FR | 2741600 A1 | * | 5/1997 |
| GB | 1 333 832 | | 10/1973 |
| JP | 07285586 A | * | 10/1995 |
| WO | WO 98/30469 | | 7/1998 |
| WO | WO 9918010 A2 | * | 4/1999 |

OTHER PUBLICATIONS

English Translation of Japanese Patent Document H7–285586.*

* cited by examiner

*Primary Examiner*—Aaron J. Lewis

(57) ABSTRACT

A hand-held pressurized product dispenser that includes a container with a hand-engageable body portion, a valve mechanism at the top of the container that is movable with respect to the container to cause pressurized discharge of the product, and a valve actuation lever that is connected to the valve mechanism and extends along the container body such that a larger displacement of the end of the lever causes a controlled, relatively smaller displacement of the valve mechanism, permitting adjustable "throttled" delivery of the product. Also disclosed are: a product delivery member that is attached to the top of container and has a product holding structure that is positioned with respect to the valve mechanism to receive aproduct and to hold the product in position for application; cam members are oriented to cause the valve actuating lever to move downward as it is moved toward the container body: and a movable stop member that is carried on the container and faces the hand-engageable portion so as to limit travel of the hand-engageable portion toward the container.

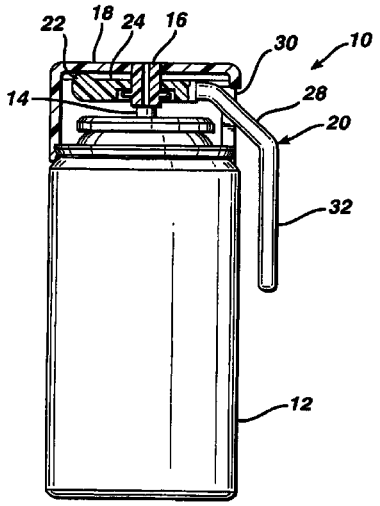

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–6 and 11–13 are cancelled.

Claims 7–9, 14 and 22–34 are determined to be patentable as amended.

Claims 10 and 15–21, dependent on an amended claim, are determined to be patentable.

New claims 35–39 are added and determined to be patentable.

7. [The hand-held pressurized product dispenser of claim 1,] *A hand-held pressurized product dispenser comprising:*

*an aerosol container containing a product under pressure, said container having a top, a hand-engageable body portion and a bottom,*

*a valve mechanism at the top of said container that communicates with said container and is movable with respect to said container to cause pressurized axial discharge of said product out of said container via a nozzle having a nozzle outlet that is axially aligned with said container,*

*a valve actuation lever that is pivotally connected to said valve mechanism via a pivotal connection and extends along said body to a lever end such that relatively larger displacement of said lever end causes a controlled, relatively smaller displacement of said valve mechanism, permitting adjustable delivery of said product,* said valve actuation lever having a first cam member that is connected to said hand-engageable portion and faces said container[.]*;*

[said container carrying] a second cam member that *is connected to said container and* faces said first cam member, said first and second cam members being oriented such that, as a hand-engageable portion of said lever is moved toward said container, interaction of said first and second cam members causes said valve actuating member to move downward to actuate said valve mechanism*;*

*and a movable stop member configured to selectively limit travel of said valve actuation lever.*

8. The dispenser of claim 7 wherein said container carries [a] *said* movable stop member facing said hand-engageable portion so as to limit travel of said hand-engageable portion toward said container, said stop member having different portions that are selectively movable into position facing said hand-engageable portion so as to adjust movement of said valve actuating member

[said container carrying a movable stop member facing said hand-engageable portion so as to limit travel of said hand-engageable portion toward said container, said stop member having different portions that are selectively movable into position facing said hand-engageable portion so as to adjust movement of said valve actuating member].

9. [The hand-held pressurized product dispenser of claim 1,] *A hand-held pressurized product dispenser comprising:*

*an aerosol container containing a product under pressure, said container having a top, a hand-engageable body portion and a bottom,*

*a valve mechanism at the top of said container that communicates with said container and is movable with respect to said container to cause pressurized axial discharge of said product out of said container via a nozzle having a nozzle outlet that is axially aligned with said container,*

*a valve actuation lever that is pivotally connected to said valve mechanism via a pivotal connection and extends along said body to a lever end such that relatively larger displacement of said lever end causes a controlled, relatively smaller displacement of said valve mechanism, permitting adjustable delivery of said product;*

[said container carrying a] *and a movable stop member configured to selectively limit travel of said valve actuation lever,*

*said* movable stop member facing a hand-engageable portion of said lever so as to limit travel of said hand-engageable portion toward said container, said stop member having different portions that are selectively movable into position facing said hand-engageable portion so as to adjust movement of said valve actuating member.

14. A hand-held pressurized product dispenser comprising a container containing product under pressure, said container having a top, a hand-engageable body portion and a bottom, a valve mechanism at the top of said container that communicates with said container and is movable with respect to said container to cause pressurized discharge of said product out of said container, a product delivery member attached to said top of said container and having a product holding structure that is positioned with respect to said valve [mechanism] to receive said product, [and]

a valve actuating member that is connected to actuate said valve and has a hand-engageable portion that extends along said body, the product holding structure is selected from a porous structure having pores that receive said product, an elastomeric applicator, a sintered structure, a structure having a textured surface, and a structure having a grid surface*, and a nozzle in communication with said valve, said nozzle being extendable above said product holding structure upon displacement of said valve actuating member and configured to facilitate lateral delivery of said product to said product holding structure.*

22. The dispenser of claim [1 or] 14 wherein said product is a shaving aid.

23. The dispenser of claim [1 or] 14 wherein said product is an antiperspirant.

24. The dispenser of claim [1 or] 14 wherein said product is a deodorant.

25. The dispenser of claim [1,] 14 [or 2] wherein said product is a body spray.

26. The dispenser of claim [1,] 14 [or 2] wherein said product is a gel.

27. The dispenser of claim [1,] 14 [or 2] wherein said product is a cream.

28. The dispenser of claim [1,] 14 [or 2] wherein said product is a semisolid.

29. The dispenser of claim [1,] 14 or [2] wherein said product is a liquid.

30. The dispenser of claim [1,] 14 [or 2] wherein said product is an after shave.

31. The dispenser of claim [1,] 14 [or 2] wherein said product is a hair spray.

32. The dispenser of claim [1,] 14 [or 2] wherein said product is a powder.

33. The dispenser of claim [1,] 14 [or 2] wherein said container is an aerosol container.

34. The dispenser of claim [1,] 14 [or 2] wherein said container has a product bag inside a pressurized chamber.

*35. A hand-held pressurized product dispenser comprising a container containing product under pressure, said container having a top, a hand-engageable body portion and a bottom, a valve mechanism at the top of said container that communicates with said container and is movable with respect to said container to cause pressurized axial discharge of said product out of said container via a nozzle having a nozzle outlet that is axially aligned with said container, and a valve actuation lever that is pivotally connected to said valve mechanism via a pivotal connection and including a first portion that extends along said body to a lever end such that relatively larger displacement of said lever end causes a controlled, relatively smaller displacement of said valve mechanism, permitting adjustable delivery of said product, and a second portion that extends over the top of the container, said valve actuation lever having a first cam member that faces said container, said container carrying a second cam member that faces said first cam member, said first and second cam members being oriented such that interaction of said first and second cam members causes said valve actuating member to move to actuate said valve mechanism as said lever is moved toward said container.*

*36. A hand-held pressurized product dispenser comprising a container containing product under pressure, said container having a top, a hand-engageable body portion and a bottom, a valve mechanism at the top of said container that communicates with said container and is movable with respect to said container to cause pressurized lateral discharge of said product out of said container via a nozzle having a nozzle outlet, a valve actuation lever that is pivotally connected to said valve mechanism via a pivotal connection and extends along said body to a lever end such that relatively larger displacement of said lever end causes a controlled, relatively smaller displacement of said valve mechanism, permitting adjustable delivery of said product, and a cap at the top of the container, said cap having an upper surface including an opening for the nozzle, wherein said nozzle is extendable above said upper surface upon displacement of said lever to facilitate lateral delivery of said product to said upper surface.*

*37. The hand-held pressurized product dispenser of claims 35 or 36 wherein the container is an aerosol container containing a product selected from the group consisting of antiperspirants, deodorants, and body sprays and wherein the valve mechanism causes pressurized axial spray discharge of said product.*

*38. The hand-held pressurized product dispenser of claim 35, wherein the nozzle extends approximately to the opening.*

*39. The hand-held pressurized product dispenser of claim 36, wherein the valve actuation lever includes a first portion that extends along said body and a second portion that extends over the top of the container beneath the upper surface of the cap.*

* * * * *